US009079330B2

(12) United States Patent
Garceau

(10) Patent No.: US 9,079,330 B2
(45) Date of Patent: Jul. 14, 2015

(54) PATTERN IMPRESSING VIA A ROLLER ELEMENT

(71) Applicant: Jerome V. Garceau, Warrenville, IL (US)

(72) Inventor: Jerome V. Garceau, Warrenville, IL (US)

(73) Assignee: Butterfield Color, Inc., Aurora, IL (US)

( * ) Notice: Subject to any disclaimer, the term of this patent is extended or adjusted under 35 U.S.C. 154(b) by 0 days.

(21) Appl. No.: 14/096,841

(22) Filed: Dec. 4, 2013

(65) Prior Publication Data

US 2014/0158004 A1 Jun. 12, 2014

Related U.S. Application Data

(60) Provisional application No. 61/733,168, filed on Dec. 4, 2012.

(51) Int. Cl.

| | |
|---|---|
| ***B05C 17/02*** | (2006.01) |
| ***B28B 11/08*** | (2006.01) |
| ***E01C 19/44*** | (2006.01) |

(52) U.S. Cl.

CPC ..... *B28B 11/08* (2013.01); *B05C 17/0207* (2013.01); *B28B 11/0809* (2013.01); *E01C 19/44* (2013.01); *B05C 17/02* (2013.01)

(58) Field of Classification Search

USPC ..... 101/28

See application file for complete search history.

(56) References Cited

U.S. PATENT DOCUMENTS

| | | | | |
|---|---|---|---|---|
| D175,354 | S * | 8/1955 | Knapp, Jr. | D4/123 |
| 3,955,260 | A * | 5/1976 | Sherden | 492/36 |
| 4,257,140 | A * | 3/1981 | Downing | 15/230.11 |
| 5,146,646 | A * | 9/1992 | Langford et al. | 15/210.1 |
| 5,228,799 | A | 7/1993 | Sondreal | |
| 5,421,670 | A | 6/1995 | Meirick | |
| 6,348,235 | B1 * | 2/2002 | Cavill et al. | 427/280 |
| D463,135 | S * | 9/2002 | Driggers | D4/123 |
| 6,923,630 | B2 | 8/2005 | Allen | |
| 2003/0211922 | A1 * | 11/2003 | Piccolo | 492/13 |
| 2008/0067717 | A1 * | 3/2008 | Lampignano | 264/293 |

* cited by examiner

*Primary Examiner* — Jill Culler

(74) *Attorney, Agent, or Firm* — Pauley Peterson & Erickson

(57) ABSTRACT

A device for impressing a pattern or design into uncured concrete having a hollow cylindrical sleeve which can be paired with a conventional paint roller with a roller applicator sleeve having a nap. The hollow cylindrical sleeve includes an inner tubular surface which includes a inner surface texture to engage the nap of the conventional paint roller and an outer surface which includes a negative relief for imprinting a texture and/or a design in uncured concrete to create an appearance of a variety of materials such as, but not limited to, brick pavers, stone, rock, and hardwood.

12 Claims, 2 Drawing Sheets

PATTERN IMPRESSING VIA A ROLLER ELEMENT

CROSS REFERENCE TO RELATED APPLICATION

This application claims the priority benefit of Provisional U.S. Patent Application, Ser. No. 61/733,168, filed on Dec. 4, 2012. This Provisional U.S. Patent Application Ser. No. 61/733,168, in its entirety, is incorporated by reference into this specification and is made a part hereof, including but not limited to those portions which specifically appear hereinafter.

BACKGROUND OF THE INVENTION

1. Field of the Invention

This invention relates generally to devices and methods such as for impressing a specifically desired pattern or form into uncured concrete for a sidewalk, floor, barrier, wall, or other selected surface, More specifically, this invention relates to a device with a negative relief for imprinting a texture into uncured concrete to create an appearance of, for example, brick pavers, stone patterns, and hardwood flooring.

2. Description of Related Art

The manufacture or creation of various specifically desired patterns or forms on wet or uncured concrete such as sidewalks, barriers, walls or other selected surfaces can oftentimes be more costly, in terms of either or both time and resources, than may ultimately be desired. As a consequence, alternative techniques for forming or creating such surfaces in actuality or in appearance have been desired and sought.

U.S. Pat. No. 5,228,799 discloses a device for imprinting patterns on concrete is formed of a lightweight cylindrical member with a raised grid pattern thereon for forming the impressions. The device of this invention requires a particular handle and cannot be used with a commonly-owned handle, such as a conventional paint roller, thereby increasing the cost for a user of this device.

U.S. Pat. No. 5,421,670 discloses a roller assembly for imprinting a pattern in a malleable surface wherein a hub is formed with a cylindrical frame that receives a pattern forming shell thereon. The device of this invention requires a motor and is limited to use with a specific handle and roller and cannot be used with a commonly-owned handle, such as a conventional paint roller.

U.S. Pat. No. 6,923,630 discloses an apparatus and a method for impressing three-dimensional patterns in a slip-formed concrete wall. At least one impression roller is provided at the discharge end of a slip form. The impression roller includes an outer periphery, provided with a layer or coating of resilient material. The layer is pre-formed or precast to include an aesthetically pleasing, three-dimensional pattern. The axis of the roller is maintained in parallel relation to the plane of the exposed surface of the wall, with the outer periphery of the roller slightly depressed into the wall surface. As the uncured concrete wall emerges from the slip form, the impression roller places a pattern into the wall surface which corresponds to the pattern on the roller. Movement of the roller along the wall causes the impression roller to rotate, impressing successively formed portions of the wall with the pattern. Additional rollers may be used to impress patterns on the opposing wall surface, as well as the top wall surface.

There is a need and demand for devices and methods of sufficiently low cost and ease of operation and implementation such as to more easily allow or permit individuals to use such devices and methods without requiring extensive training or practice and without requiring costly specialized utensils or tools.

SUMMARY OF THE INVENTION

A general object of the invention is to provide improved devices and/or methods such as for impressing a specifically desired pattern or form onto a sidewalk, barrier, wall, or other selected surface.

A more specific objective of the invention is to overcome one or more of the problems described above.

These and other objects of this invention are addressed by a device for impressing a design into uncured concrete including a hollow cylindrical sleeve which can be paired with a conventional paint roller with a roller applicator with a nap. The hollow cylindrical sleeve preferably includes an inner tubular surface which includes a surface texture to engage the nap of the conventional paint roller and an outer surface which includes a negative relief for imprinting a texture and/or a design in uncured concrete to create an appearance of a variety of materials such as, but not limited to, brick pavers, stones, and hardwood. Alternatively the negative relief can be used to create impressions of logos, characters, nature scenes, trademarks quotes, sayings, and other visual impressions. In a preferred embodiment, the hollow cylindrical sleeve further includes a taper on each end. The taper minimizes or preferably avoid undesired contact of the ends of the hollow cylindrical sleeve to the uncured concrete.

In an alternative embodiment, the hollow cylindrical sleeve can be joined to another type of handle which allows the hollow cylindrical sleeve to rotate without requiring a conventional paint roller.

In a preferred embodiment, the hollow cylindrical sleeve is manufactured from a durable material which stands up to repeated impressions on concrete including, for example, Shore A urethane, Shore D urethane, silicone, latex, plastic, and any other material known to one having skill in the art.

DETAILED DESCRIPTION OF THE INVENTION

The present invention provides an improved device for impressing a specifically desired pattern or form onto uncured concrete such as a sidewalk, floor, barrier, wall, or other selected surface. Also provided are corresponding or associated methods for impressing a specifically desired pattern or form onto a sidewalk, barrier, wall, or other selected surface.

Figure 1:
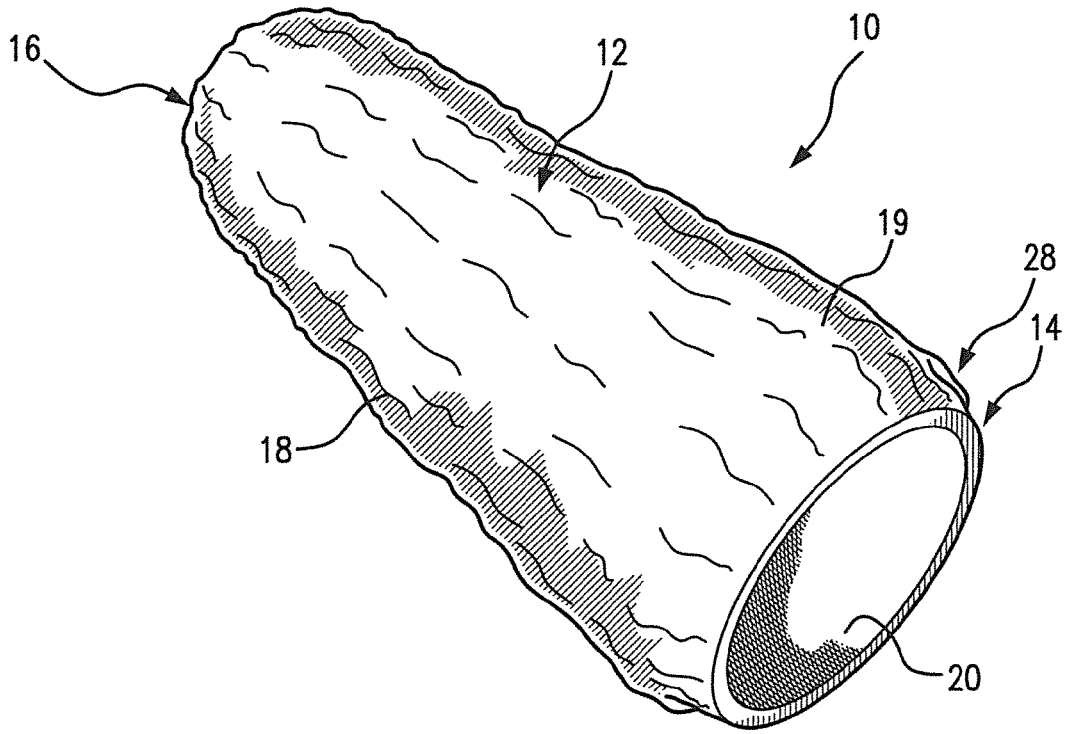
FIG. 1 is a perspective angled side view of a roller element, in accordance with one embodiment of the invention, for impressing a pattern onto a desired surface.
Figure 2:
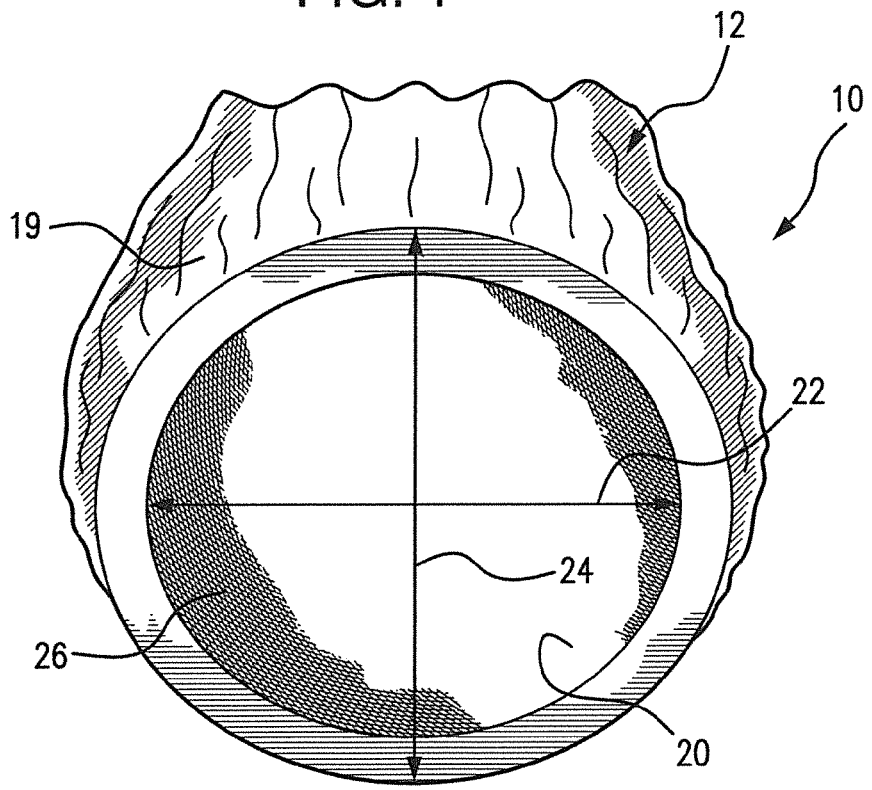
FIG. 2 is a perspective end view of the surface-impressing roller element shown in FIG. 1.

FIGS. 1 and 2 illustrate a surface-impressing roller element, in accordance with one embodiment of the invention and generally designated by the reference numeral 10. As detailed further below, the surface-impressing roller element 10 is useful for impressing a desired selected pattern onto a chosen surface of uncured or wet concrete.

The surface-impressing roller element 10 can desirably have or be in the form of a hollow cylindrical sleeve such as adapted to fit over and engage with a conventional or standard paint roller element. For example, the surface-impressing roller element 10 can generally include a hollow cylindrical sleeve 12 having opposed ends 14 and 16, an outer surface 18 with a negative relief 19 formed, shaped or textured to provide a desired surface impression upon application or use, and an inner surface 20. By way of example and not necessarily limitation, the outer surface 18 can be formed, shaped or textured to provide desired surface impression upon application or use such as in the form or appearance of brick, stone, rock, wood or other materials as may be desired in a specific or particular application. Thus, those skilled in the art and guided by the teachings herein provided will appreciate that the broader practice of the invention is not necessarily limited or restricted by or to the form or appearance of the surface impression resulting from the use of a roller element in accordance with the invention.

As perhaps best seen by reference to FIG. 2, the surface-impressing roller element 10 and, more specifically the hollow cylindrical sleeve 12 has an inner diameter 22 and an outer diameter 24. Further, the inner surface 20 may, in accordance with one embodiment of the invention, desirably include appropriate cross hatching or other selected surface texturing, generally designated by the reference numeral 26, to better ensure desired engagement with an associated conventional or standard paint roller element such as may desirably be inserted or disposed there within, such as described in greater detail below.

Surface-impressing roller elements in accordance with the invention can be desirably fabricated or manufactured from various materials such as known in the art including, for example, Shore A urethane (such as Shore A urethane with a durometer in the range of 25 to 100), Shore D urethane, silicone, latex, or any other material known to one skilled in the art. Further, those skilled in the art and guided by the teachings herein provided will understand and appreciate that surface-impressing roller elements in accordance with the invention can be desirably fabricated or manufactured by various techniques including, for example, injection molding.

Figure 3:
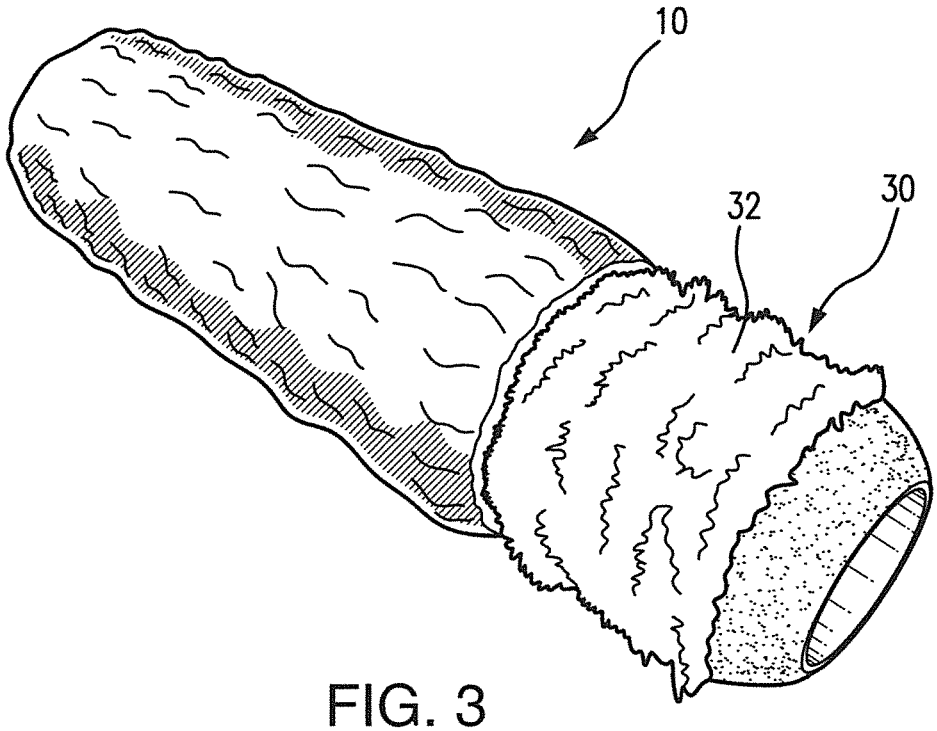
FIG. 3 is a perspective angled side view showing a conventional paint roller sleeve partially inserted into the surface-impressing roller element shown in FIG. 1.
Figure 4:
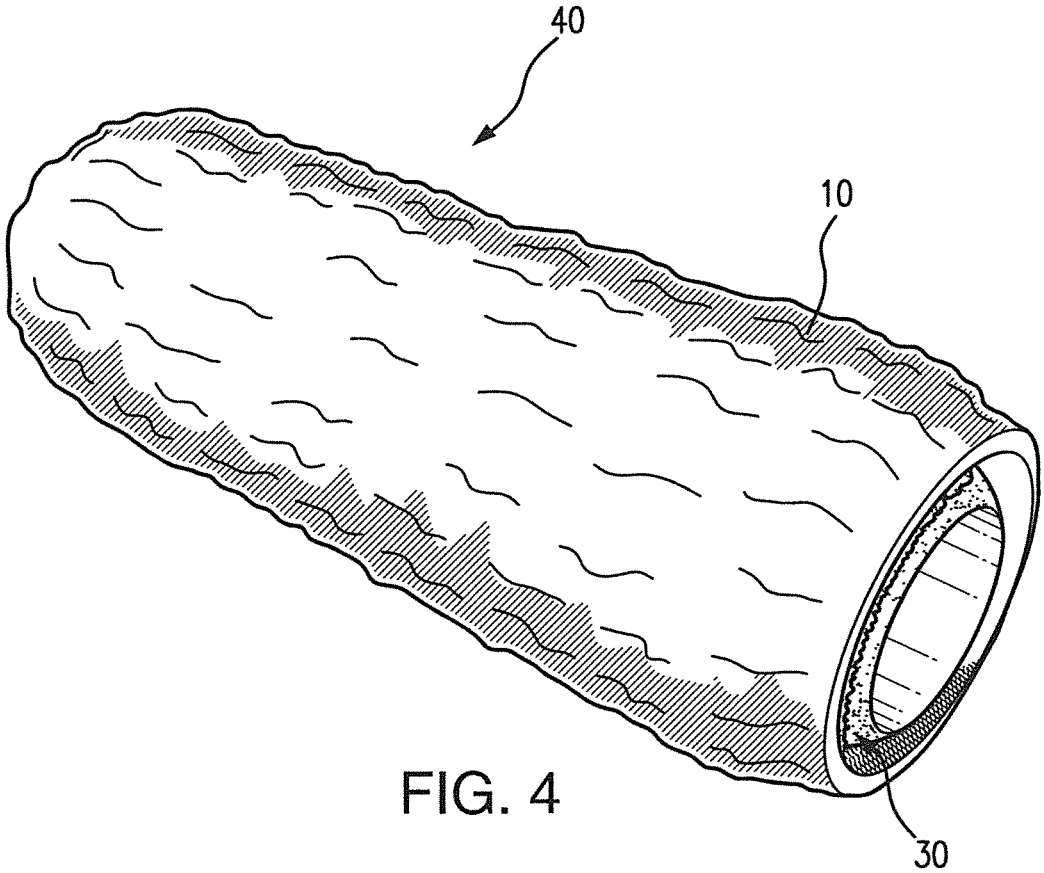
FIG. 4 is a perspective angled side view showing the surface-impressing roller element shown in FIG. 1 and the conventional paint roller sleeve shown in FIG. 3 but now with the conventional paint roller sleeve fully inserted within the surface-impressing roller element.

Turning now to FIGS. 3 and 4, there is shown a conventional paint roller sleeve, generally designated by the reference numeral 30 being and then completely inserted into the surface-impressing roller element 10 such as to form a combination designated by the reference numeral 40. As will be appreciated by those skilled in the art and guided by the teachings herein provided, surface-impressing roller elements in accordance with the invention can be variously sized as may be desired for specific applications. For example, surface-impressing roller elements in accordance with selected preferred embodiments of the invention can be appropriately sized, e.g., have an appropriate inner diameter 22 such as to permit and ensure desired and proper placement and use with standard sized paint roller sleeve such as having ½, ¾, ⅜ inch or other sized nap. In an alternative embodiment, the surface-impressing roller elements in accordance with the invention can be sized to fit directly to the paint roller without a paint roller sleeve.

As shown, the outer surface 18 of the surface-impressing roller element 10 can, if desired, be tapered 28 at or adjacent either or both the ends 14 and 16, respectively, such as to minimize or preferably avoid undesired contact of the specifically formed, shaped or textured outer surface at such end portions.

Further, the as identified above, the conventional paint roller sleeve 30 includes a nap 32 of such size, shape and/or form to facilitate engagement with the associated surface-impressing roller element 10. More particularly, the surface-impressing roller element 10 and more specifically the inner surface 20 thereof such as including cross hatching or other selected surface texturing 26 (shown in FIG. 2), engages with the paint roller sleeve 30 and, more specifically, the nap 32 to form a stable component effective to impress a desired pattern or form onto a surface upon which the surface-impressing roller element 10 is applied. More specifically, the firm engagement of the paint roller sleeve 30 with the surface-impressing roller element 10 preferably prevents slipping or movement of the surface-impressing roller element 10 relative to the paint roller sleeve 30.

In a preferred embodiment shown in FIGS. 1-4 such engagement is preferably ensured by a tight press fit of the roller element 10 relative to the paint roller sleeve 30 and particularly the flexible nap of the paint roller sleeve 30. According to another preferred embodiment of the invention, the surface-impressing roller element 10 may be constructed of latex or similar highly flexible material and may be elastically rolled onto the paint roller sleeve 30 thereby creating a tight engagement between the surface-impressing roller element 10 and the paint roller sleeve 30.

With the paint roller sleeve 30 appropriately inserted and engaged with the surface-impressing roller element 10, there is formed the combination 40 such that the surface-impressing roller element 10 can be appropriately rolled over or onto a desired selected surface such as to impress the form, shape or texture of the surface-impressing roller element 10 there onto.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A device for impressing a design into uncured concrete comprising:

a hollow cylindrical sleeve comprising an inner surface and an outer surface including a negative relief;

wherein the hollow cylindrical sleeve slides over a conventional paint roller and the inner surface engages with a nap of the conventional paint roller; and wherein the inner surface includes a selected surface texture to engage the nap of the conventional paint roller, to prevent slipping or movement of the hollow cylindrical sleeve relative to the conventional paint roller.

2. The device of claim 1 wherein the negative relief imprints a texture in the uncured concrete to create an appearance of at least one of brick, stone, rock, and wood.

3. The device of claim 1 wherein the surface texture comprises cross hatching to engage the nap of the conventional paint roller.

4. The device of claim 1 wherein the hollow cylindrical sleeve is manufactured from at least one of Shore A urethane, Shore D urethane, silicone, latex and plastic.

5. The device of claim 4 wherein the hollow cylindrical sleeve is manufactured using an injection molding process.

6. The device of claim 1 wherein the hollow cylindrical sleeve includes a tapered end.

7. A device for impressing a design into uncured concrete comprising:

a handle including a rotatable member, wherein the handle comprises a conventional paint roller and a paint roller sleeve including a nap; and a hollow cylindrical sleeve comprising an inner surface and an outer surface including a negative relief, wherein the inner surface of the hollow cylindrical sleeve slides over the rotatable member and the inner surface includes a selected surface texture to engage the nap to prevent slipping or movement of the hollow cylindrical sleeve relative to the conventional paint roller.

8. The device of claim 7 wherein the negative relief imprints a texture in the uncured concrete to create an appearance of at least one of brick, stone, rock, and wood.

9. The device of claim 7 wherein the surface texture comprises cross hatching to engage the rotatable member.

10. The device of claim 7 wherein the hollow cylindrical sleeve is manufactured from at least one of Shore A urethane, Shore D urethane, silicone, latex and plastic.

11. The device of claim 10 wherein the hollow cylindrical sleeve is manufactured using an injection molding process.

12. The device of claim 7 wherein the hollow cylindrical sleeve includes a tapered end.

* * * * *